United States Patent [19]

Van Leeuwen et al.

[11] Patent Number: 4,919,337

[45] Date of Patent: Apr. 24, 1990

[54] ARC ADJUSTMENT FOR IRRIGATION SPRINKLER

[75] Inventors: Timothy O. Van Leeuwen; Billy J. Hobbs, Jr., both of Gardnerville, Nev.

[73] Assignee: GardenAmerica Corporation, Carson City, Nev.

[21] Appl. No.: 339,203

[22] Filed: Apr. 10, 1989

[51] Int. Cl.[5] ..... B05B 3/16; B05B 3/04

[52] U.S. Cl. ..... 239/205; 239/206; 239/241; 239/242

[58] Field of Search ..... 239/205, 206, 203, DIG. 1, 239/240–242

[56] References Cited

U.S. PATENT DOCUMENTS

| | | | |
|---|---|---|---|
| 3,035,778 | 5/1962 | Kimbro et al. | 239/206 |
| 3,038,666 | 6/1962 | Dudley et al. | 239/206 |
| 3,107,056 | 10/1953 | Hunter | 239/240 X |
| 3,526,363 | 9/1970 | Hauser | 239/206 |
| 3,645,451 | 2/1972 | Hauser | 239/206 |
| 3,724,757 | 4/1973 | Hunter | 239/203 |
| 3,934,820 | 1/1976 | Phaup | 239/205 |
| 4,091,997 | 5/1978 | Ridgway | 239/206 |
| 4,417,691 | 11/1983 | Lockwood | 239/206 |
| 4,624,412 | 11/1986 | Hunter | 239/232 |
| 4,625,914 | 12/1986 | Sexton et al. | 239/206 |
| 4,634,052 | 1/1987 | Grizzle et al. | 239/205 |
| 4,650,118 | 3/1987 | Saarom et al. | 239/206 |

*Primary Examiner*—Andres Kashnikow
*Assistant Examiner*—Kevin P. Weldon
*Attorney, Agent, or Firm*—Barry E. Deutsch; J. Bruce Hoofnagle

[57] ABSTRACT

An irrigation sprinkler with an internal assembly which is caused to turn back and forth through a preset arc so that a nozzle at the upper end of the assembly may irrigate a sector of land of a particular size, and in which the internal assembly arc of the internal assembly is adjustable by depressing a spring-loaded arc-adjust screw in the end of the assembly by a small standard screwdriver, or the like, and rotating the screw either clockwise or counterclockwise to decrease or increase the arc.

10 Claims, 3 Drawing Sheets

ARC ADJUSTMENT FOR IRRIGATION SPRINKLER

BACKGROUND OF THE INVENTION

Sprinkler heads with rotatable pop-up nozzles propelled by water pressure are presently in widespread use. It is an objective of the present invention to provide simple means for adjusting the arc of movement of the nozzle, either to increase or decrease the sector covered by the sprinkler.

The sprinkler to be described is similar to the mechanism of U.S. Pat. No. 4,650,118 which issued Mar. 17, 1987, and which is assigned to the present Assignee. However, it will be evident as the description proceeds that the invention is not limited to such a sprinkler.

Like the sprinkler described in U.S. Pat. No. 4,650,118, the sprinkler of the present invention includes a pop-up assembly having a nozzle at its upper end which is caused to rise up out of the housing by inlet water pressure. The nozzle is then turned back and forth through a pre-set arc to irrigate a sector of land of a particular size.

In accordance with the invention, a spring-loaded screw is provided in the upper end of the pop-up assembly which, when depressed, engages gear teeth on outer and lower tubular risers which make up the poppet assembly. Then, when the screw is turned, the relative angular positions of the risers are changed to adjust the arc of travel of the nozzle.

DETAILED DESCRIPTION OF THE ILLUSTRATED EMBODIMENT

Figure 1:
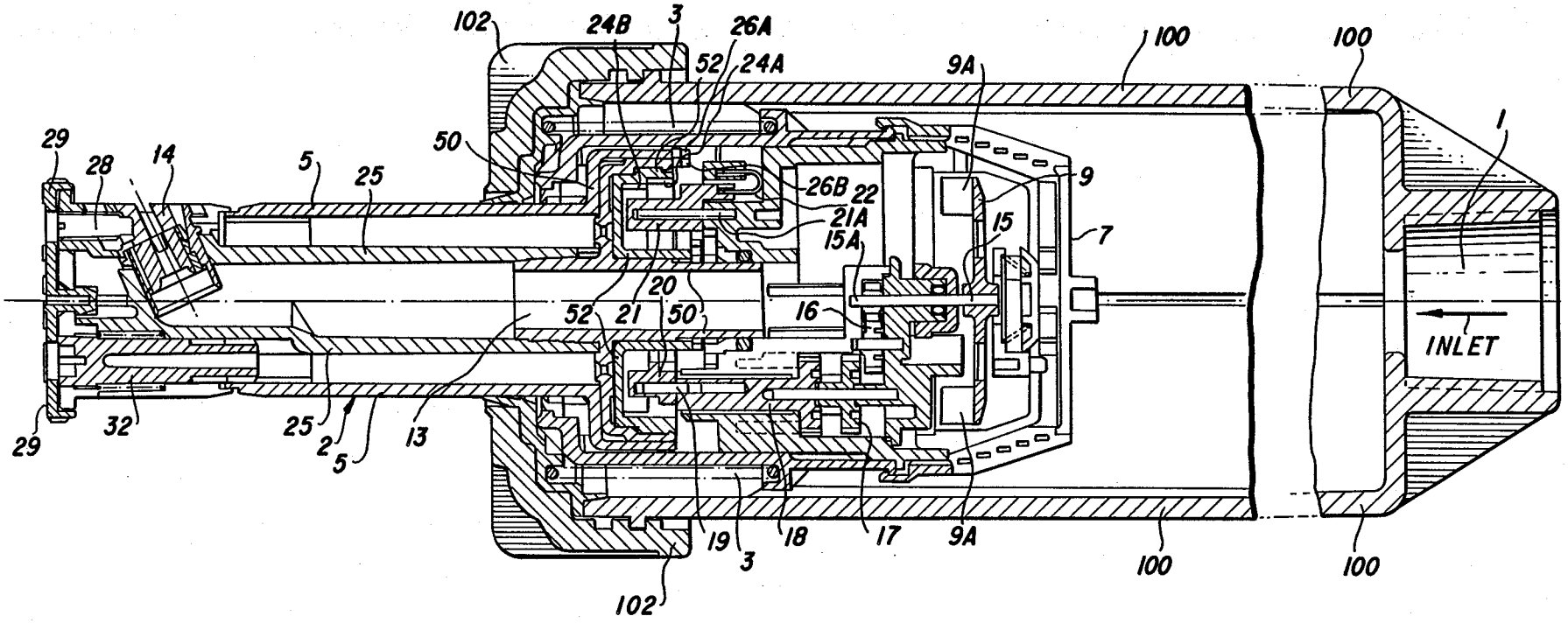
FIG. 1 is a side sectional view of a sprinkler head constructed in accordance with the present invention in one of its embodiments.

The irrigation sprinkler assembly shown in FIG. 1, for example, includes a tubular housing 100 having an inlet 1 at one end through which water under pressure is introduced into the interior of the housing. A pop-up assembly designated generally as 2 is coaxially mounted within the tubular housing for axial movement within the housing from a retracted position to an operational position (shown in FIG. 1) in which the pop-up assembly protrudes through a central opening in a cap 102 mounted on the other end of housing 100. The pop up assembly is spring-biased to its retracted position by a spring 3, and it is forced into its illustrated operational position by water pressure introduced into the housing 100 through inlet 1. The pop-up assembly 2 includes an outer tubular riser 5 and a coaxial inner tubular riser assembly 25.

A water-driven motor including a rotor 9 is mounted on the inner end of the pop-up assembly. Water is introduced into the motor through a screen filter 7, and the water passes through the motor and through an internal axial passage 13 in the inner riser 25 to a nozzle assembly 14 mounted on the upper end of the inner riser. A cap 29 is mounted on the upper end of the inner riser by a snap fit therewith.

Rotor 9 of the motor is coupled through a drive shaft 15 to a pinion 15A. Pinion 15A drives an idler gear 16 which, in turn, drives an output shaft 18 through a series of reduction gears 17. The rotor 9 has a series of rotor blades 9A against which the incoming water pressure is directed and which cause the rotor to rotate. The output shaft drives an axial eccentric pin 19 which operates a pawl 20, shown in FIG. 2.

Figure 2:
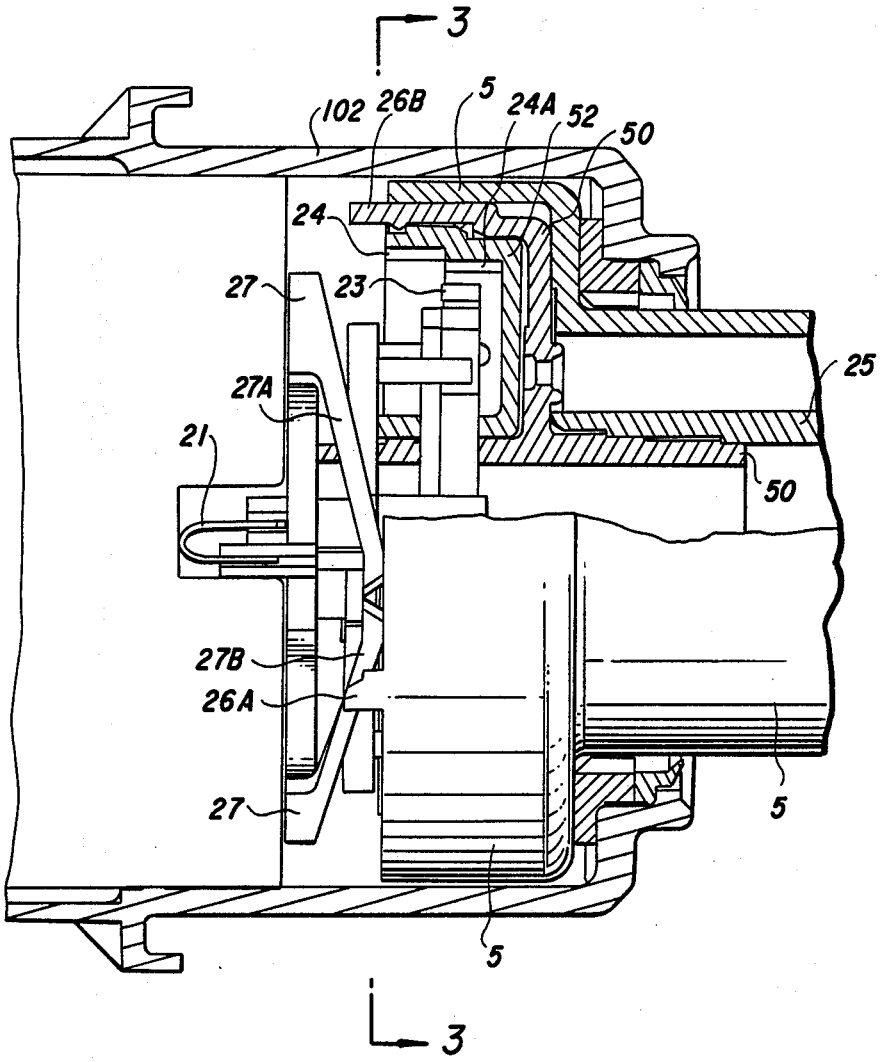
FIG. 2 is a sectional view of a portion of the sprinkler-head.
Figure 3:
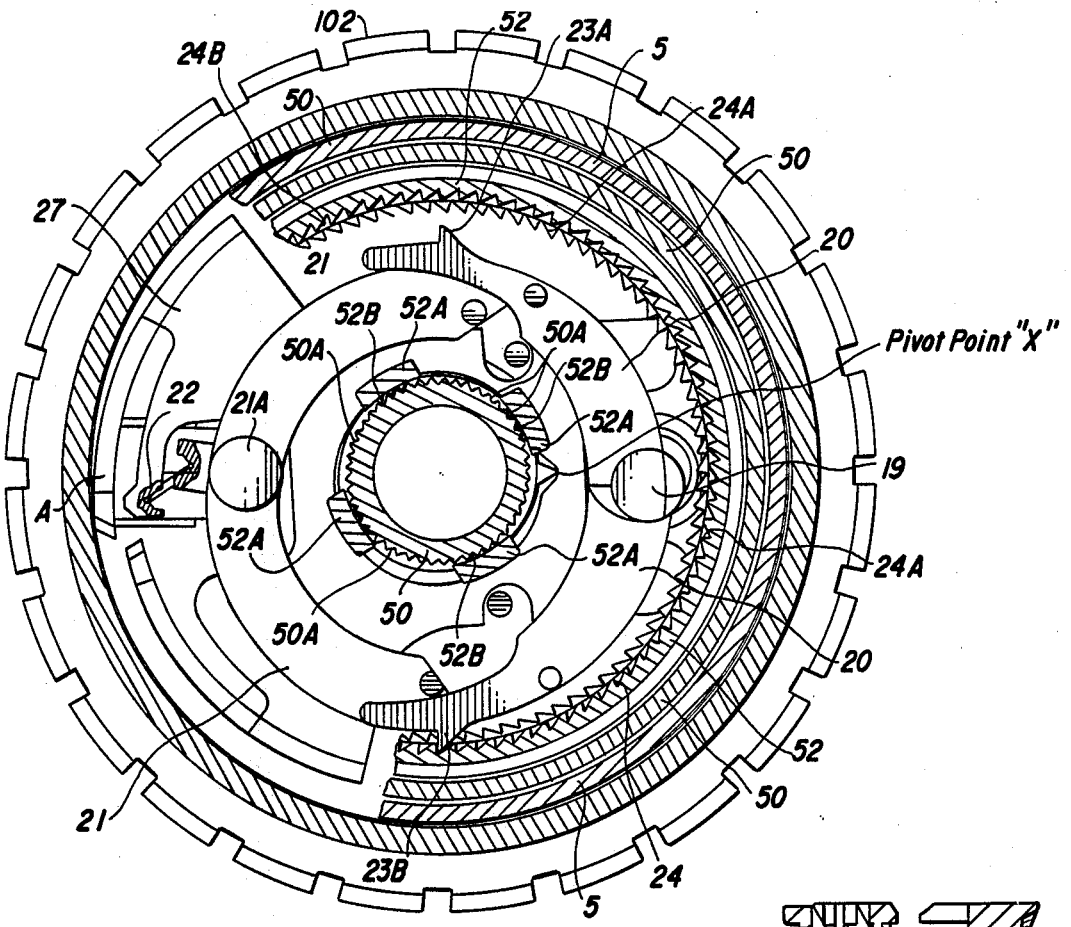
FIG. 3 is a cross-sectional view taken along the line 3—3 of FIG. 2.

Pawl 20, as shown in FIG. 2 is engaged by an arcuate follower 21 which is pivotally mounted on a shaft 21A. An over-center spring 22 causes the follower 21 to turn the follower in a first direction to force a projection 23A at one end of pawl 20 into engagement with a first set of saw teeth 24A formed on the bottom of the inner riser assembly 25; or alternately to turn the pawl so that a tooth 23B at its other end engages a second set of teeth 24B on the end of the inner riser assembly 25. The teeth 24A and 24B are oppositely directed, so that when the pawl 20 engages teeth 23A the pop-up assembly is caused to turn in one direction, and when the pawl engages the teeth 23B the pop-up assembly is caused to turn in the opposite direction.

The teeth 24A and 24B are actually formed on the interior surface of a ring member 52 which is coupled to the inner riser assembly 25 through a tubular member 50. These elements actually form a protective clutch with the inner riser as is described in more detail in Copending Application (K-3319).

The follower 21 is moved angularly between its first and second positions by a shifter 27 which is pivotally mounted on the inner end of the inner riser at a pivot point X. As best shown in FIG. 2, the outer riser 5 has a trip tab 26A protruding from its lower end, and the tubular member 50 attached to the inner riser assembly 25 has a trip tab 26B protruding from its inner end. The shifter mechanism 27 has a pair of resilient fingers 27A and 27B. Finger 27A is engaged by tab 26A, for example, when the pop-up assembly reaches a particular limiting angular position; and resilient finger 27B is engaged by trip tb 26B when the pop-up assembly is turned to its other limiting position.

When the trip tabs engage the resilient fingers of the shifting mechanism, they cause the shifting mechanism to move from one position to another causing the follower 21 to actuate the over-center spring 22, and thereby moving the pawl assembly 20 from one position to another. The positions of the trip tabs 26A and 26B may be adjusted by controlling the relative angular positions of the inner riser assembly 25 and outer riser 5, and this is achieved by rotating screw 32 (FIG. 1), as will be described in more detail in conjunction with FIGS. 4 and 5.

As described and claimed in Copending Application (K-3315) the fingers 27A and 27B of the shifter 27 are resilient, and when either the trip tab 26A or the trip tab 26B is forced against the corresponding resilient finger 26A or 27B of the shifter 27, instead of breaking off the trip tab, the corresponding resilient finger 27A or 27B is forced downwardly enabling the particular trip tab 26A, 26B to pass over the resilient finger. Then, subsequent rotation by the internal motor 9 will cause the internal mechanism again to reset itself to its original setting so that the sprinkler may continue to operate without damage.

Figure 5:
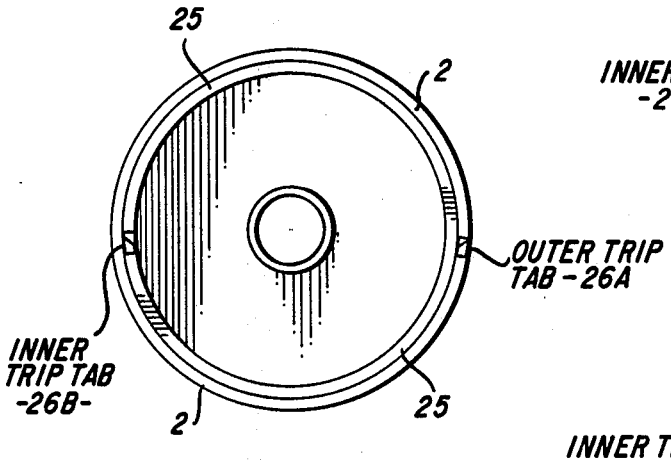
FIG. 5 is a simplified schematic bottom view of the poppet assembly.
Figure 4:
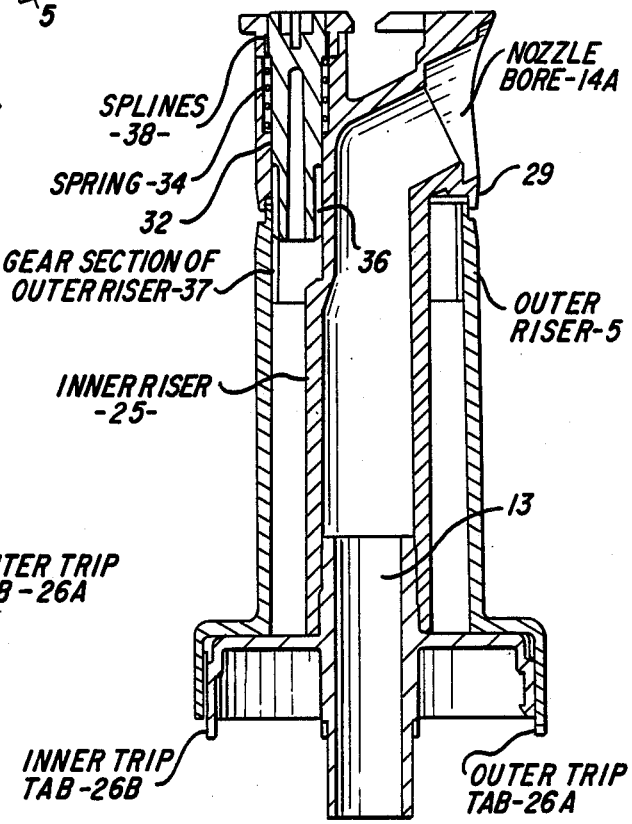
FIG. 4 is a simplified schematic elevational section of the poppet assembly of the sprinkler.

As shown in FIGS. 4 and 5, the pop-up assembly is formed of the coaxial inner riser assembly 25 and outer riser 5. Water flows into the pop-up assembly through channel 30 and, as described above, is discharged out through a nozzle 14 which is mounted in a nozzle bore 14A. Cap 29 is attached to the top of the inner riser by a screw 30 (FIG. 1), and by a spring-loaded screw 32 (FIGS. 1 and 4).

As shown in FIG. 4, screw 32 is spring-loaded by a spring 34. The lower end of screw 32 has vertical gear teeth thereon which engage vertical gear teeth 34 on the outer riser and vertical gear teeth 36 on the inner riser. Rotation of screw 32 when in the position of FIG. 4 is prevented by splines 38 which lock the risers 25 and 5 to a preset mutual angular position.

In order to adjust the relative positions of the trip tabs 26A and 26B which, as described above, control the points at which the rotation of the nozzle is reversed and, accordingly, the arc of coverage of the sprinkler, it is necessary to adjust the relative angular positions of the inner riser assembly 25 and outer riser 5.

This is achieved by inserting a small screwdriver into the slot at the top of screw 32 (FIG. 4). The screw 32 is pushed down, and its vertical gear teeth are released from the splines 38. Then, rotation of screw 32 in either direction causes the inner and outer risers 5 and 25 to turn relative to one another so as to adjust the spacing between trip tabs **26*a* and 26*b***. This action, as described above, adjusts the arc of rotation of the pop-up assembly, either to increase or decrease the segment of land covered by the sprinkler.

It will be appreciated that while a particular embodiment of the invention has been shown and described, modifications may be made. It is intended in the claims to cover all modifications which come within the true spirit and scope of the invention.

We claim:

1. In a sprinkler head comprising a tubular housing having an inlet at one end, an internal assembly rotatably mounted in said housing for discharging water over a sector of land to be irrigated in response to water introduced under pressure into the housing through the inlet, said internal assembly including inner and outer tubular members rotatably mounted in said tubular housing in coaxial relationship therewith and with one another; a drive member movable between first and second positions to engage one or the other of said inner and outer tubular members to cause said internal assembly to turn in opposite directions in said housing, a reversing assembly movable between first and second positions to cause said drive member to engage one or the other of said inner and outer tubular members, a first trip tab mounted on the inner end of said inner tubular member for moving said reversing assembly to its first position, and a second trip tab mounted on the inner end of said outer tubular member for moving said reversing assembly to its second position, said tabs serving to reverse the direction of rotation of said nozzle at trip points determined by the relative angular positions of said inner and outer tubular members, the combination of: vertical teeth formed on said outer tubular member on the inner surface thereof; and an adjustable screw mounted on the end of said internal assembly and extending into said internal assembly between said inner and outer tubular members, said screw having vertical gear teeth engaging the vertical gear teeth on said outer tubular member so that rotation of said screw adjusts the relative angular positions of said inner and outer tubular members to adjust the angular displacement of said inner and outer trip tabs from one another.

2. The combination defined in claim 1, and which includes a cap mounted on said inner tubular member, and in which said screw is mounted on said cap and extends through said cap.

3. The combination defined in claim 2, in which said cap has a multiplicity of vertical teeth formed thereon, and said screw has a matching multiplicity of vertical teeth and is adjustable between a first position in which the vertical teeth thereof engage said vertical teeth of said cap to lock the inner and outer tubular members at preset relative angular positions, and a second position in which said teeth of said screw are displaced from said teeth of said cap to permit relative angular movements of the inner and outer tubular members.

4. The combination defined in claim 3, and which includes resilient loading means coupled to said screw for returning said screw to its first position.

5. The combination defined in claim 4, in which said screw has means at the upper end thereof to receive adjustment means to move the screw from its first to its second position and then to turn the screw to adjust the relative angular positions of the inner and outer tubular members.

6. In a sprinkler head comprising a tubular housing having an inlet at one end, a pop-up assembly, a nozzle mounted at the end of said pop-up assembly, said pop-up assembly being mounted within the housing and movable longitudinally with respect to the housing from a retracted position within the housing to an operational position in which the pop-up assembly protrudes through the other end of the housing to enable the nozzle to discharge water over a sector of land to be irrigated in response to water introduced under pressure into the housing through the inlet, said pop-up assembly including inner and outer tubular risers slidably and rotatably mounted in said tubular housing in coaxial relationship therewith and with one another, the inner perimeter of the inner end of said inner riser having two oppositely directed adjacent sets of teeth formed thereon; a pawl movable between first and second positions to engage one or the other of said sets of teeth to cause said pop-up assembly to turn in opposite directions in said housing, a reversing assembly movable between first and second positions to cause said pawl to engage one or the other of said sets of teeth, a first trip tab mounted on the inner end of said inner riser for moving said reversing assembly to its first position, and a second trip tab mounted on the inner end of said outer riser for moving said reversing assembly to its second position, said tabs serving to reverse the direction of rotation of said nozzle at trip points determined by the relative angular positions of said inner and outer risers, the combination of: vertical teeth formed on said outer riser on the inner surface thereof; and an adjustable screw mounted on the end of said pop-up assembly and extending into said pop-up assembly between said inner and outer risers, said screw having vertical teeth engaging the vertical teeth on said riser so that rotation of said screw adjusts the relative angular positions of said inner and outer risers to adjust the angular displacement of said inner and outer trip tabs from one another.

7. The combination defined in claim 6, and which includes a cap mounted on said inner riser, and in which said screw is mounted on said cap and extends through said cap.

8. The combination defined in claim 7, in which said cap has a multiplicity of vertical teeth formed thereon, and said screw has a matching multiplicity of vertical teeth and is adjustable between a first position in which the vertical teeth thereof engage said vertical teeth of said cap to lock the inner and outer risers at preset relative angular positions, and a second position in which said teeth of said screw are displaced from said teeth of said cap to permit relative angular movements of the inner and outer risers.

9. The combination defined in claim 8, and which includes resilient loading means coupled to said screw for returning said screw its first position.

10. The combination defined in claim 9, in which said screw has a slot at the upper end thereof to receive a screwdriver to move the screw from its first to is second position and then to turn the screw to adjust the relative angular positions of the inner and outer risers.

* * * * *

UNITED STATES PATENT AND TRADEMARK OFFICE

CERTIFICATE OF CORRECTION

PATENT NO. : 4,919,337

DATE : April 24, 1990

INVENTOR(S) : Timothy O. Van Leeuwen; Billy J. Hobbs, Jr.; Charles A. Ray; Myrl J. Saarem It is certified that error appears in the above-identified patent and that said Letters Patent is hereby corrected as shown below:

On the title page field [75] should appear as follows:
-- [75] Inventors: Timothy O. Van Leeuwen; Billy J. Hobbs, Jr.; Charles A. Ray, all of Gardnerville, Nevada, and Myrl J. Saarem of Carson City, Nevada.--

Column 2, line 31, delete "(K-3319)" and insert --Serial No. 334,326, filed on April 7, 1989--.

Column 2, line 56, delete "(K-3315)" and insert --Serial No. 335,694, filed on April 10, 1989,--

Signed and Sealed this

Fourth Day of February, 1992

*Attest:*

HARRY F. MANBECK, JR.

*Attesting Officer*

*Commissioner of Patents and Trademarks*